United States Patent [19]

Baltz et al.

[11] Patent Number: 4,870,392

[45] Date of Patent: Sep. 26, 1989

[54] FLUID FLOW RESTRICTION WARNING INDICATOR

[75] Inventors: Gene F. Baltz, Lake Villa; Paul R. Hunt, Lindenhurst, both of Ill.

[73] Assignee: Outboard Marine Corporation, Waukegan, Ill.

[21] Appl. No.: 365,617

[22] Filed: Apr. 5, 1982

[51] Int. Cl.[4] ..... G08B 21/00

[52] U.S. Cl. ..... 340/608; 340/614; 340/626

[58] Field of Search ..... 200/81 R, 83 R; 340/614, 608, 626, 52 R; 417/38, 63; 123/41.15, 198 D, 198 C, 198 DB; 73/112, 113, 115

[56] References Cited

U.S. PATENT DOCUMENTS

| | | | |
|---|---|---|---|
| 3,140,368 | 7/1964 | Young et al. | 340/626 |
| 3,448,434 | 6/1969 | Nolte et al. | 200/81.9 R |
| 3,882,861 | 5/1975 | Kettering et al. | 417/44 |
| 4,019,489 | 4/1977 | Cartmill | 123/41.45 |
| 4,136,330 | 1/1979 | Estaque | 340/59 |

FOREIGN PATENT DOCUMENTS

| | | | |
|---|---|---|---|
| 0013295 | 1/1982 | Japan | 417/38 |

*Primary Examiner*—Robert L. Griffin
*Assistant Examiner*—Wellington Chin
*Attorney, Agent, or Firm*—Michael, Best & Friedrich

[57] ABSTRACT

Disclosed is an engine fuel flow restriction warning system comprising an engine including a first conduit means connecting a fuel storage means and a fuel pumping means. A second conduit means connects a fuel pumping means with an engine fuel inlet means. Pressure sensing means communicates with the first conduit means, and the pressure sensing means operates a warning means to produce a warning when the pressure in the first conduit means reaches a predetermined low level. When used with an engine including a cooling system and a cooling system temperature sensing means communicating with the engine cooling system, the temperature sensing means operates the same pressure warning means to produce a warning when the temperature in the engine cooling system reaches a predetermined level.

10 Claims, 1 Drawing Sheet

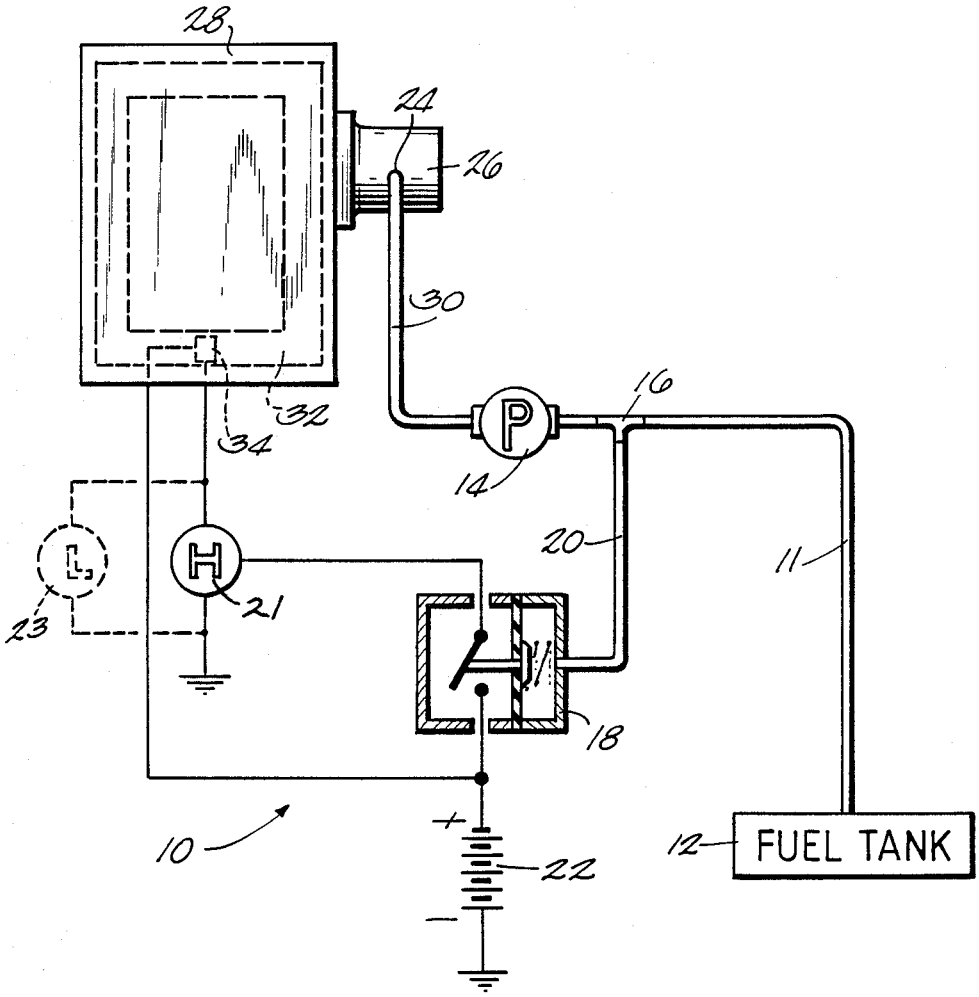
28
24
26
30
32
34
16
14
20
11
23
21
18
10
+
22
−
12
FUEL TANK

FLUID FLOW RESTRICTION WARNING INDICATOR

BACKGROUND OF THE INVENTION

This invention relates to fluid flow restriction warning systems, and more particularly, to fuel flow restriction warning systems used in conjunction with an internal combustion engine.

A fuel line between a fuel tank and a fuel pump sometimes becomes restricted. When this restriction occurs, the absence of fuel to the fuel pump and to the engine receiving the fuel can cause damage to the engine. Two-cycle engines are especially susceptible to damage because the engine's lubricant is mixed with the fuel.

In order to avoid damage to the engine, it is desirable to provide a warning system which will indicate when the fuel line between the fuel tank and the fuel pump becomes restricted. Hatsuno et al U.S. Pat. No. 4,261,209 provides a pressure sensing means between a fuel pump and an engine's fuel inlet. Dey U.S. Pat. No. 4,029,073 and Corseen U.S. Pat. No. 2,683,782 provides systems for sensing pressure vacuums in air manifold systems. Young et al U.S. Pat. No. 3,140,368 provides a system for detecting the difference in pressure between the inlet and outlet sides of a fuel pump and Nolte et al U.S. Pat. No. 3,448,434 provides a pressure sensing device for use in a fuel line. Other U.S. patents of interest are listed below:

| Patentee | Patent No. |
|---|---|
| Polymeros | 2,666,197 |
| Korte et al | 2,497,029 |
| Wright | 2,923,926 |
| Goodman | 3,738,346 |
| Cartmill | 4,019,489 |
| Robinson | 4,099,166 |

SUMMARY OF THE INVENTION

This invention provides an engine fuel flow restriction warning system comprising an engine including a first conduit means connecting a fuel storage means and a fuel pumping means. A second conduit means connects a fuel pumping means with an engine fuel inlet means. Pressure sensing means communicates with the first conduit means, and the pressure sensing means operates a warning means to produce a warning when the pressure in the first conduit means reaches a predetermined low level. When used with an engine including a cooling system and a cooling system temperature sensing means communication with the engine cooling system, the temperature sensing means operates the same pressure warning means to produce a warning when the temperature in the engine cooling system reaches a predetermined level.

In one embodiment of the invention, the pressure sensing means is an electromechanical vacuum switch and the warning means is an electric horn. In another embodiment of the invention, a flow restriction warning system includes a conduit means connected to a flow inlet on a fluid pumping means, with the conduit means adapted to be connected to a source of fluid. Pressure sensing means communicating with the conduit means operates a warning means to produce a warning when the pressure in the conduit means reaches a predetermined low level.

One of the principal features of the invention is the provision of a warning system which indicates when a restriction occurs in the fluid line between a source of fluid and a fluid pump.

Another of the principal features of the invention is the provision of such a warning device which does not activate when an engine is either started or stopped.

Another of the principal features of the invention is the provision of such a system which makes use of an existing over-heat warning system.

Other features and advantages of embodiments of the invention will become apparent upon reviewing the following drawings, the detailed description and the appended claims.

BRIEF DESCRIPTION OF THE DRAWINGS

FIG. 1 is a schematic diagram of an engine fuel flow restriction warning system.

Before explaining at least one embodiment of the invention in detail, it is to be understood that the invention is not limited in its application to the details of construction and the arrangements of the components set forth in the following description or illustrated in the drawing. The invention is capable of other embodiments and of being practiced or carried out in various ways. Also, it is to be understood that the phraseology and terminology employed herein is for the purposes of description and should not be regarded as limiting.

DESCRIPTION OF THE PREFERRED EMBODIMENT

Shown in FIG. 1 is one embodiment of a fuel restriction warning system 10 including a first conduit means or first hose 11 connecting a fuel storage means or fuel tank 12 to a fuel pumping means or fuel pump 14. Spliced in the first hose 11 is a T-shaped connector 16. A pressure sensing means 18, attached via a hose 20 to the T-shaped connector 16, permits the pressure sensing means 18 to be in communication with the first hose 11 and sense the fuel pressure in the first hose 11.

The pressure sensing means 18 in this embodiment is an electromechanical vacuum switch 18. The switch 18 is of a conventional design which, when a predetermined design pressure is reached, engages an electrical switch to close an electrical circuit. The circuit closed includes an electric horn 21 and a power source 22, such as battery. The closed electric circuit causes the horn 21 to sound thereby warning persons within the hearing distance of the horn 21 of a low pressure or vacuum situation in the first hose 11 which has resulted from a fuel restriction in the hose 11.

Another embodiment of a fuel restriction warning system could include an electric light 23 instead of an electric horn 21.

The fuel pump 14 shown in this embodiment is connected to an engine fuel inlet means or fuel inlet 24. The fuel inlet 24 is a port in a carburetor 26 on an internal combustion engine 28 (shown schematically in FIG. 1). A second conduit means or second hose 30 connects the fuel pump 14 to the fuel inlet 24.

The engine 28 in this embodiment includes an engine cooling system 32 (illustrated in FIG. 1 by the dashed enclosed portion within the engine). In communication with the engine cooling system 32 is a cooling system temperature sensing means 34 of a conventional design wherein when the temperature in the engine cooling system 32 reaches a predetermined design temperature, an electrical switch incorporated in the temperature sensing means closes an electrical circuit. This electrical circuit includes the electrical horn 21 and the power source 22. The closing of the electrical circuit causes the horn 21 to sound thereby warning persons within the hearing distance of the horn of a high temperature situation in the engine cooling system. The electrical horn 21 and the power source 22 used in this temperature warning system are the same as that used with the fuel restriction warning system 10.

We claim:

1. An engine fuel flow warning system comprising an engine including an engine fuel inlet means, fuel storage means, fuel pumping means, first conduit means connecting said fuel storage means and said fuel pumping means, second conduit means connecting said fuel pumping means and said engine fuel inlet means, an electrically operated warning means, and an electromechanical vacuum switch communicating with said first conduit means and electrically connected between said warning means and a source of electrical energy and operable so that, when the pressure in said first conduit means reaches a predetermined low level, said vacuum switch energizes said warning means to produce a warning.

2. An engine fuel flow restriction warning system according to claim 1, wherein said warning means is an audible means.

3. An engine fuel flow restriction warning system according to claim 3, wherein said audible means is an electric horn.

4. An engine fuel flow restriction warning system according to claim 1, wherein said warning means is a visual means.

5. An engine fuel flow restriction warning system according to claim 4 wherein said visual means is an electric light.

6. An engine warning system comprising an engine including an engine fuel inlet means and an engine cooling system, fuel storage means, fuel pumping means, first conduit means connecting said fuel storage means and said fuel pumping means, second conduit means connecting said fuel pumping means and said engine fuel inlet means, electrically operated warning means, an electromechanical vacuum switch communicating with said first conduit means and electrically connected between said warning means and a source of electrical energy and operable so that, when the pressure in said first conduit means reaches a predetermined low level, said vacuum switch energizes said warning means to produce a warning, and cooling system temperature sensing means communicating with said engine cooling system and electrically connected between said warning means and the source of electrical energy in parallel with the connection of said vacuum switch and operable so that, when the temperature in said engine cooling system reaches a predetermined level, said temperature sensing means energizes said warning means to produce a warning.

7. A flow restriction warning system according to claim 6 wherein said warning means is an audible means.

8. A flow restriction warning system according to claim 7 wherein said audible means is an electric horn.

9. A flow restriction warning system according to claim 6 wherein said warning means is a visual means.

10. A flow restriction warning system according to claim 9 wherein said visual means is an electric light.

* * * * *